United States Patent [19]

Hoehn

[11] 3,997,802

[45] Dec. 14, 1976

[54] TEMPERATURE-COMPENSATED ZENER DIODE ARRANGEMENT

[75] Inventor: Wolfgang Hoehn, Kirchzarten, Germany

[73] Assignee: ITT Industries, Inc., New York, N.Y.

[22] Filed: Oct. 21, 1975

[21] Appl. No.: 624,640

[30] Foreign Application Priority Data

Nov. 2, 1974 Germany ..... 2452107

[52] U.S. Cl. ..... 307/310; 307/303; 307/318

[51] Int. Cl.[2] ..... H03K 17/00

[58] Field of Search ..... 307/318, 310, 303; 357/28

[56] References Cited

UNITED STATES PATENTS

| | | | |
|---|---|---|---|
| 3,400,306 | 5/1968 | Knauss | 357/28 |
| 3,567,965 | 3/1971 | Weinerth | 307/310 |
| 3,596,115 | 7/1971 | Conzelmann | 307/303 |
| 3,780,322 | 12/1973 | Walters | 357/28 |

*Primary Examiner*—Stanley D. Miller, Jr.
*Assistant Examiner*—B. P. Davis
*Attorney, Agent, or Firm*—John T. O'Halloran; Peter Vander Sluys; Vincent Ingrassia

[57] ABSTRACT

This relates to a temperature-compensated zener diode arrangement in the form of a semiconductor integrated circuit which consists of several transistor structures disposed in a common semiconductor body and interconnected by deposited metallizations. The base-emitter pn junctions of the transistor structures are so connected in series with respect to the direction of the total current flowing during operation that some of them are operated in the reverse direction up to the breakdown region as zener diodes and the remainder in the forward direction as forward bias diodes. The emitter of the first transistor structure acting as a zener diode or the base of a transistor structure acting as a forward bias diode, as well as the collector of the latter transistor structure, are connected to the first external terminal. The emitter of the latter transistor structure, acting as a forward bias diode, is connected to the second external terminal. The transistor structures acting as zener diodes are disposed in a first isolating island of the semiconductor body and the transistor structures acting as forward biased diodes are disposed in additional isolating islands.

6 Claims, 2 Drawing Figures

TEMPERATURE-COMPENSATED ZENER DIODE ARRANGEMENT

BACKGROUND OF THE INVENTION

The present invention relates to a temperature-compensated zener diode arrangement constructed in the form of a semiconductor integrated circuit which consists of several transistor structures arranged in a common semiconductor body and interconnected by deposited metallizations. The base-emitter pn junctions of the transistor structures are so connected in series with respect to the direction of the total current flowing during operation that part of them are operated in the reverse direction up to the breakdown region as zener diodes, and the remainder in the forward direction as forward-biased diodes.

These temperature-compensated zener diode arrangements have a temperature coefficient which permits them to be used in varactor-tuned radio and television receivers where they generate the temperature-stable and constant bias required to tune the varactors. In this case, the known temperature-compensated zener diode arrangements are operated like a conventional zener diode, i.e., a conventional shunt regulator is formed by means of a series resistor having one end connected to an unregulated dc voltage source.

With the development of the tuners into fully electronic tuners with touch contact operation and remote control capability, the power consumption of the tuning voltage source regulated by means of a conventional temperature-compensated zener diode arrangement has become so large that the zener diode arrangement is traversed by such a high total current as to be operated near the maximum permissible power dissipation, i.e., the temperature of the semiconductor body may be up to 100° C higher than the ambient temperature. The case temperature of the temperature-compensated zener diode arrangement is only slightly lower than the temperature of the semiconductor body.

As a result of this high temperature drop between the semiconductor body and the surroundings, the semiconductor body's temperature may greatly vary despite a constant ambient temperature. The reason is that in the television set further power-dissipating components cause air convection which increases the removal of the heat generated by the temperature-compensated zener diode arrangement. Since, however, this air convection is not of the laminar, but of the turbulent kind, this means that the temperature of the semiconductor body constantly varies with time.

A further change in the temperature of the semiconductor body results from variations in the unregulated voltage, e.g. from line voltage variations. In case of heavy current drain from the shunt regulator, which fact causes the above-mentioned high shunt current in the zener diode arrangement, this may result in this shunt current varying by a factor of 2 to 3 for line voltage variations between +15% and −20%; this, in turn, may lead to a great change in the temperature of the semiconductor body, e.g., to a temperature change from 30° to 100° C.

Since, on the other hand, the known temperature-compensated zener diode arrangements have, of course, a small but not negligible temperature coefficient, such great changes in the temperature of the semiconductor body result in intolerable variations in the stabilized voltage.

SUMMARY OF THE INVENTION

Since in the known temperature-compensated zener diode arrangements the expense of an improvement in the temperature co-efficient by semiconductor techniques is prohibitive, it is the object of the present invention to provide a temperature-compensated zener diode arrangement which solves the above problems by keeping the variations in the regulated voltage so small that they do not lead to any noticeable frequency shift in the varactor-tuned radio or television sets. Thus, the known temperature-compensated zener diode arrangements are to be improved so that, with a justifiable expenditure on semiconductor devices (crystal size, usability of the standard planar technique, same case, same maximum power dissipation) they can be used in voltage regulators from which the current required for fully electronic tuners can be taken without the voltage- and temperature-regulating properties being adversely affected thereby.

According to a broad aspect of the invention, there is provided a temperature-compensated zener diode arrangement in the form of a semi-conductor integrated circuit having first, second and third external terminals, which circuit consists of several transistor structures disposed in a common semiconductor body and interconnected by deposited metallizations, wherein the base-emitter pn junctions of the transistor structures are so connected in series with respect to the direction of the total current flowing during operation that part of them are operated in the reverse direction up to the breakdown region as zener diodes and the remainder in the forward direction as forward biased diodes, comprising: first and second transistor structures each having base, emitter and collector terminals, said first and second transistor structures for acting as zener diodes and disposed at least partly in a first isolating island of the semiconductor body, the emitter and collector of said first semiconductor structure and the collector of said second transistor structure coupled to said first external terminal, the emitter of said second transistor structure coupled to the base of said first transistor structure and the base of said second transistor structure coupled to said second external terminal; third and fourth transistor structures, each having base, emitter and collector terminals, said second and third transistor structures at least partly disposed in a second isolating island of the semiconductor body for acting as forward bias diodes, the base of said third transistor structure coupled to the base of said second transistor structure and to said second external terminal, the collector of said third transistor structure and the collector of said fourth transistor structure coupled to said third external terminal, the emitter of said third transistor structure coupled to said second external terminal and to the base of said fourth transistor structure and the emitter of said fourth transistor structure coupled to said second external terminal; and a bipolar element external to said semiconductor integrated circuit coupled between said first and third external terminals.

The advantage gained by the invention lies in the fact that in the semiconductor integrated circuit considerably less heat is lost than in the known arrangements, whereby the temperature of the semiconductor body lies only slightly above the ambient temperature without the temperature-compensating properties of the overall circuit being adversely affected.

The above and other objects of the present invention will be more clearly understood from the following detailed description taken in conjunction with the accompanying drawing, in which:

DESCRIPTION OF THE PREFERRED EMBODIMENT

Figure 1:
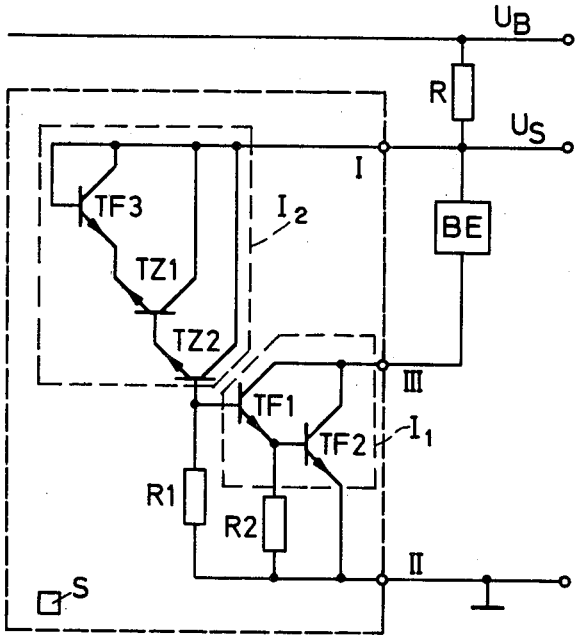
FIG. 1 is the equivalent circuit diagram of a temperature-compensated zener diode arrangement in accordance with the invention.

In FIG. 1, the equivalent circuit of the integrated portion of the zener diode arrangement according to the invention is shown within the dashed rectangle which indicates the semiconductor circuit. Preferably, the case is a plastic case as used with transistors. The semiconductor circuit is fabricated in a semiconductor body by the planar technique commonly used for the monolithic integration of bipolar circuits. Disposed at one surface of the semiconductor body are the regions needed for the semiconductor circuit and isolated from each other by pn junctions, the so-called isolating islands. The semiconductor body itself, generally referred to as the "substrate," has an electric contact of its own, which is designated S in FIG. 1; in the equivalent circuit diagram, however, it is not connected to any of the circuit elements because it has no functional electrical connection with the individual structures of the integrated circuit.

FIG. 1 shows two transistor structures TZ1, TZ2 which act as zener diodes, and three transistor structures TF1, TF2, TF3 which act as forward-biased diodes. All transistor structures have their base-emitter pn junctions connected in series and are arranged between the first external terminal I and the second external terminal II. A resistor R1 is inserted between the base of the transistor structure TF1 and the external terminal II, and a resistor R2 is connected between the base of the transistor structure TF2 and this terminal.

It should be emphasized that the number of forward-biased diodes and zener diodes is dependent on the desired voltage value to be stabilized, as is explained in detail in German Published Applications 1,589,707 and 1,539,867.

The collectors of the two transistor structures TF1, TF2 of FIG. 1, acting as forward-biased diodes, are connected to the third external terminal III, while the emitter of the transistor TF2 is connected to the second external terminal II. The two transistor structures TF1, TF2 acting as forward-biased diodes are disposed in one isolating island $I_1$ of the semiconductor body.

The transistor structures TZ1, TZ2 acting as zener diodes are also disposed in an isolating island of their own $I_2$ and have their collectors connected to the first external terminal I, to which are also connected the base and the collector of the other transistor structure TF3 acting as a forward-biased diode, which, together with the transistor structures TZ1, TZ2, is disposed in the latters' isolating island.

Outside the case of the semiconductor integrated circuit, a linear or non-linear bipolar component BE is connected between the first and the third external terminal. During operation, this component is traversed by a large part of the shunt current flowing through the temperature-compensated zener diode arrangement; thus, in connection with the voltage drop across this component, a large part of the heat lost in the overall arrangement is lost outside the case of the semiconductor integrated circuit. As a result, the semiconductor body will heat to a much lower temperature than the known temperature-compensated zener diode arrangements, and variations in the unregulated voltage $U_B$, which is applied to the arrangement through the series resistor R, have a considerably reduced effect on the stability of the regulated voltage $U_S$.

Figure 2:
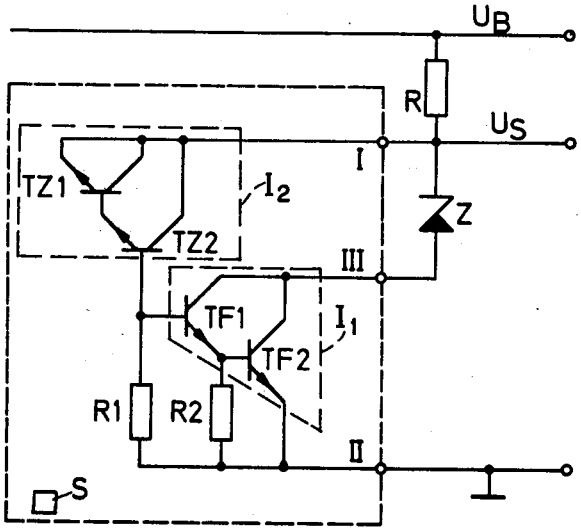
FIG. 2 is the equivalent circuit diagram of another temperature-compensated zener diode arrangement in accordance with the invention.

FIG. 2 shows the equivalent circuit diagram of another temperature-compensated zener diode arrangement according to the invention in which the forward-biased-diode transistor structure TF3 of FIG. 1, disposed in the isolating island of the transistor structures acting as zener diodes, is not present. Thus, the emitter of the transistor structure TZ1 is connected to the first external terminal I. As the non-linear bipolar component, the zener diode Z is provided, which is inserted between the first and third external terminals. Its zener voltage must be chosen taking into account the collector-emitter saturation voltages of the two transistor structures TF1, TF2, which act as forward-biased diodes, and the regulated voltage $U_S$.

Because of the structure of the semiconductor integrated circuit, which is different from that of the known temperature-compensated zener diode arrangements, and the resulting different design of the semiconductor body, an undesirable tendency towards oscillations may occur during the operation of the arrangement according to the invention, i.e., the overall circuit may act in an undesirable manner as a generator of an oscillation of more or less high frequency. To avoid this possible effect, in a preferred embodiment of the invention, a measure is taken which is usually considered inappropriate in semiconductor integrated circuits: The semiconductor body is connected via its substrate terminal S to the third external terminal III. Experts basically are of the opinion that in commonly used semiconductor integrated circuits the substrate terminal must always be connected to the most negative point of the overall circuit. The preferred embodiment of the invention deliberately departs from this and connects the substrate terminal to a circuit point whose potential may be subjected to even large voltage variations during operation, namely if the bipolar component BE used is a component without distinct limiting characteristic, such as a normal resistor or a VDR. It came as a complete surprise to the inventor that this measure resulted in the desired suppression of oscillations without interferring with the intended operation of the overall circuit as a temperature-compensated zener diode arrangement.

As previously mentioned, the bipolar component used may be a zener diode, a normal resistor, or a VDR. It is also possible, however, to employ glow lamps or light-emitting diodes.

The further measures mentioned in the above referred to German Published Application 1,589,707 for the design of a temperature-compensated zener diode arrangement as well as the measures described in German Published Applications 1,639,173 and 1,764,251 can also be used in the invention. This applies in particular to the arrangement for the fine adjustment of the temperature coefficient which is described in the latter Published Applications and comprises a further transistor structure which is inserted in the series circuit of the transistor structures acting as forward-biased diodes and as zener diodes and whose base-emitter path and whose base-collector path each have one resistor connected thereto.

While the principles of this invention have been described above in connection with specific apparatus, it is to be understood that this description is made only by way of example and not as a limitation on the scope of the invention as set forth in the objects and features thereof and in the accompanying claims.

What is claimed is:

1. A temperature-compensated zener diode arrangement in the form of a semiconductor integrated circuit having first, second and third external terminals, which circuit consists of several transistor structures disposed in a common semiconductor body and interconnected by deposited metallizations, wherein the base-emitter pn junctions of the transistor structures are so connected in series with respect to the direction of the total current flowing during operation that part of them are operated in the reverse direction up to the breakdown region as zener diodes and the remainder in the forward direction as forward biased diodes, comprising:

first and second transistor structures each having base, emitter and collector terminals, said first and second transistor structures for acting as zener diodes and disposed at least partly in a first isolating island of the semiconductor body, the emitter and collector of said first semiconductor structure and the collector of said second transistor structure coupled to said first external terminal, the emitter of said second transistor structure coupled to the base of said first transistor structure and the base of said second transistor structure coupled to said second external terminal;

third and fourth transistor structures, each having base, emitter and collector terminals, said second and third transistor structures at least partly disposed in a second isolating island of the semiconductor body for acting as forward bias diodes, the base of said third transistor structure coupled to the base of said second transistor structure and to said second external terminal, the collector of said third transistor structure and the collector of said fourth transistor structure coupled to said third external terminal, the emitter of said third transistor structure coupled to said second external terminal and to the base of said fourth transistor structure and the emitter of said fourth transistor structure coupled to said second external terminal; and a bipolar element external to said semiconductor integrated circuit coupled between said first and third external terminals.

2. A temperature-compensated zener diode arrangement according to claim 1 further including a fifth transistor structure acting as a forward biased diode and coupled between said first transistor structure and said first external terminal, said fifth transistor structure having base, emitter and collector terminals, said base and collector terminals coupled to said first external terminal and said emitter terminal coupled to the emitter of said first transistor structure.

3. A temperature-compensated zener diode arrangement according to claim 2 wherein said fifth transistor structure is disposed in said first isolating island.

4. A temperature-compensated zener diode arrangement according to claim 2 wherein said bipolar component is linear.

5. A temperature-compensated zener diode arrangement according to claim 2 wherein said bipolar component is non-linear.

6. A temperature-compensated zener diode arrangement according to claim 2 wherein a terminal on said semiconductor body is connected to said third external terminal.

* * * * *